US005919410A

United States Patent [19]

Jeng

[11] Patent Number: 5,919,410

[45] Date of Patent: Jul. 6, 1999

[54] METHOD OF FIBER SPLITTING FOR CONJUGATED FIBER

[76] Inventor: Meng-song Jeng, 5Fl., No. 1 Lane 107, Changlu Rd., Changhua, Taiwan

[21] Appl. No.: 08/564,487

[22] Filed: Nov. 29, 1995

Related U.S. Application Data

[63] Continuation-in-part of application No. 08/346,506, Nov. 29, 1994, abandoned.

[51] Int. Cl.[6] ..... D01F 1/04; D01F 1/10

[52] U.S. Cl. ..... 264/78; 264/146; 264/172.14; 264/172.17; 264/172.18; 264/211; 264/211.15

[58] Field of Search ..... 264/78, 103, 130, 264/146, 147, 172.11, 172.14, 172.17, 172.18, 211, 211.12, 211.14, 211.15

[56] References Cited

U.S. PATENT DOCUMENTS 3,585,264 6/1971 Thomas ..... 264/211 X
3,700,545 10/1972 Matsui et al. ..... 264/172.11 X
3,853,977 12/1974 Matsui et al. ..... 264/103
4,381,274 4/1983 Kessler et al. ..... 264/147
4,460,649 7/1984 Park et al. ..... 264/147 X
5,047,189 9/1991 Lin ..... 264/103

*Primary Examiner*—Leo B. Tentoni
*Attorney, Agent, or Firm*—Schmeiser, Olsen & Watts

[57] ABSTRACT

A method for fiber splitting for conjugated fiber, which includes the steps of i) preparing polymers: charging a first polymer and a second polymer respectively into corresponding extruders and adding a nucleated agent, releasing agent or catalyst into one of the first and second polymers to differentiate crystallinity between the first and the second polymers, or differentiate crystallinity by adjusting viscosities thereof at different temperatures; ii) spinning: the first and second polymers are transferred to a spinning zone and are spun at a winding speed of 3000 to 8000 meters per minute to be conjugated fiber via a spin pack; iii) weaving; and iv) dyeing finishing, and the conjugated fiber is split during the dyeing and finishing step without any physical and chemical treatments.

4 Claims, 3 Drawing Sheets

METHOD OF FIBER SPLITTING FOR CONJUGATED FIBER

This application is a Continuation-in-Part (CIP) of U.S. Ser. No. 08/346,506 filed on Nov. 29, 1994, now abandoned.

BACKGROUND OF THE INVENTION

The present invention relates to a method of fiber spitting and, more particularly, to a method of fiber splitting for conjugated fiber, which is executed by differentiating crystallinities of polymers. Further particularly, the present invention is concerned with a method of fiber splitting for conjugated fiber by adding a nucleated agent, a releasing agent or a catalyst into any one of the polymers of manufacturing the conjugated fiber, or by differentiating the viscosity of the polymers during the process of manufacturing the conjugated fiber, or raising a winding speed of the fiber after a spinning process.

For a purpose of conveniently describing the methods of fiber splitting, the materials chosen for use in the conventional methods and the method in accordance with the present invention which will be described below are limited to be polyamides or polyesters, however, these limited materials should not be deemed to be a restriction of the invention.

There are two conventional methods widely used in fiber splitting of conjugated fiber, which are firstly a method of fiber splitting by physical treatment (or fiber splitting by mechanical treatment) and secondly, a method of fiber splitting by chemical treatment. Referring to FIG. 1, the method of fiber splitting by physical treatment comprises five steps listed hereinbelow:

a) preparing polyamides and polyesters with a conventional chemical reaction;

b) spinning: referring to FIG. 2, charging polyamide 10 and polyester 20 into respective extruders 30 and heating therein to melt them and then being extruded into a spin pack 32 via a metering gear pump 31. Polyamide 10 and polyester 20 are discharged from the metering gear pump 31 and the spin pack 32 by a winding machine 70 at a speed of 500–1500 meter/minute via a quenching zone 40, a drawing zone 50 and a heat setting zone 60 to form a conjugated fiber 80 as shown in FIG. 3.

c) fiber splitting by false twisting: twisting the conjugated fiber 80 at a speed of 200 twists/minute and then proceeding with a false twisting step at an overfeed rate about 0.5% and a heating temperature around 180 degrees centigrade in order to let the conjugated fiber 80 possess two different features of shrinkage and elongation, such that the conjugated fiber 80 is in a loosened state.

d) weaving; and e) dyeing and finishing.

However, such a method has the following drawbacks:

i) the fiber is easily slitted before proceeding with the weaving process, which results in a lower strength and makes the fiber in a crimped state, therefore causes a frequent breaking of the fiber, and this will cause an interruption during the weaving process, which is adverse to the entire manufacturing process.

ii) the split conjugated fiber does not have a uniform constructure strength, which will reduce the duty life of the conjugated fiber.

Referring to FIG. 4, the method of fiber splitting by chemical treatment includes six steps:

a) preparing polyamide and polyester;

b) spinning the polyamide and polyester into a conjugated fiber;

c) weaving;

d) mercerizing: adding NaOH to the conjugated fiber to dissolve partial of the polyester portion of the conjugated fiber;

e) rinsing: to wash NaOH out from the conjugated fiber; and f) dyeing and finishing.

Such a method by chemical treatment is better than the method by physical treatment but still has the following drawbacks:

i) because the conjugated fiber has a good feature of absorption, there is still some NaOH maintained in the conjugated fiber after the rinsing step and which will make the greige slightly yellow which will result in some dyeing problems thereafter and there is difficulty in removing all oligomers produced after mercerizing step, which will pollute the dyeing house.

ii) for different types of combination of the conjugated fiber, such as the combination of circular, tubular, triangular, square and hexagonal cross-section fibers, the difference of the mercerizing speed will cause one of the polyamide or polyester to be mercerized severely, the constructure strength of the conjugated fiber is thus decreased.

iii) the quality of the conjugated fiber is dependent on the rate of the mercerizing process, 1% of the rate difference of mercerizing will make the feel of touch very different. Thus, the rate difference of mercerizing process should not generally be over 13%.

iv) the storing stability of the chemical agents used in the method of chemical treatment, the safety guarantee and homogeneity during operation, and the required cooling conditions for the chemical agents, the treatment of the exhausted solution after the rinsing step and so on are serious problems with regard to environmental consideration and the expenditure thereof.

Therefore, there has been a long and unfulfilled need for a method of fiber splitting for conjugated fiber to solve the above-mentioned problems.

SUMMARY OF THE INVENTION

The present invention provides a method of splitting of conjugated fiber, which includes four steps:

i) preparing polymers: charging a first polymer and a second polymer respectively into corresponding extruders and adding a nucleated agent or a releasing agent or a catalyst into one of the first or second polymers to differentiate the crystallinity between the first and the second polymers, or to differentiate the crystallinity between the first and second polymers by adjusting the viscosity through controlling the temperature;

ii) spinning: the first and second polymers are transferred to a spinning zone and are spun at a winding speed of 3000 to 8000 meters per minute to be a conjugated fiber via a spin pack in which there is a plurality of orifices defined in an under side;

iii) weaving; and iv) dyeing and finishing.

It is an object of the present invention to provide a method of splitting of conjugated fiber, comprising differentiating the crystallinity between the polymers which are formed of the conjugated fiber after the polymers are spun, and then obtain a conjugated fiber. The conjugated fiber is split without adding NaOH or any other chemical agents therein.

Other objects, advantages, and novel features of the invention will become more apparent from the following detailed description when taken in conjunction with the accompanying drawings.

DETAILED DESCRIPTION OF THE PREFERRED EMBODIMENTS

Figure 5:
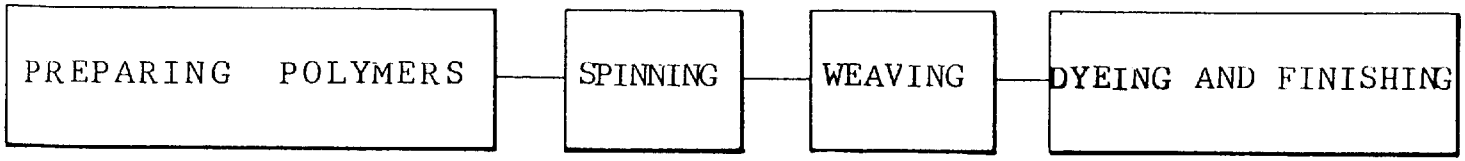
FIG. 5 is a flow chart of a method of fiber splitting for conjugated fiber in accordance with the present invention.

Referring to the drawings and initially to FIG. 5, a method of fiber splitting for conjugated fiber in accordance with the present invention generally includes four steps:

i) preparing polymers: charging a first polymer 10 and a second polymer 20 respectively into corresponding extruders 30 and differentiating crystallinity between the two polymers 10 and 20 by one of the following ways:

a) adding a nucleated agent into one of the first and second polymers 10 and 20 in a concentration of 1000 to 5000 ppm., such as $CaSiO_3$, $SiO_2$ and $MOS_2$ etc., to enhance the crystallinity of one of the two polymers 10 or 20, so as to reduce a surface frictional coefficient thereof and receive a feature of being easily released;

b) adding a releasing agent, such as super fine TEFLON™ (tetrafluoroethylene) powder into one of the first or the second polymers 10, 20 to increase a releasing feature thereof in order to receive a feature of being released with ease from the other polymer;

c) adding a catalyst, such as a non-crystallized polymer into one of the first and the second polymers 10, 20 to raise boiling shrinkage thereof from 10% to 25% such that the two polymers 10, 20 are released easily; and d) differentiating the viscosity of the polymers 10, 20 by adjusting the melting temperatures so as to release the two polymers 10 and 20 easily.

ii) spinning: the first and second polymers 10, 20 are transferred to a spinning zone 32 and spun to be a conjugated fiber 80 via a spin pack;

iii) weaving; and iv) dyeing and finishing.

In such a method, because the spinning process is executed while a filament of the conjugated fiber is in a bundle state which is nearly split, the constructive strength thereof is not reduced, and this can avoid from interruption of the polymers 10 and 20, and the conjugated fiber will be split during the step of dyeing and finishing. In other words, the method of the present invention provides a method to let the conjugated fiber be split without any chemical or physical treatments.

Figure 6:
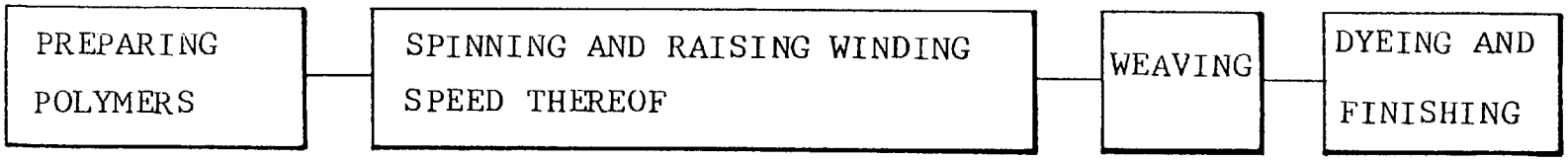
FIG. 6 is a flow chart of another embodiment of a method of fiber splitting for conjugated fiber in accordance with the present invention.
Figure 1:
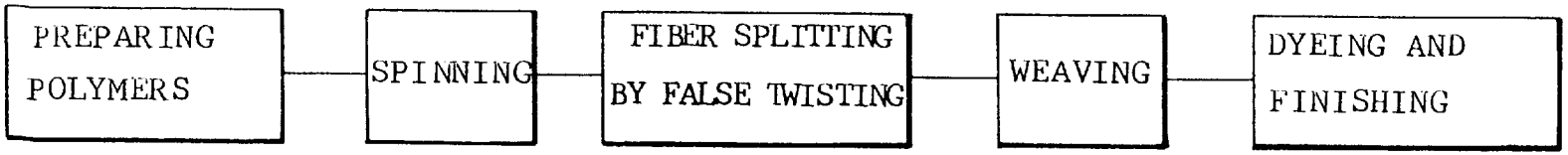
FIG. 1 PRIOR ART
FIG. 1 is a flow chart of a prior art method of fiber splitting for conjugated fiber by physical treatment.
Figure 2:
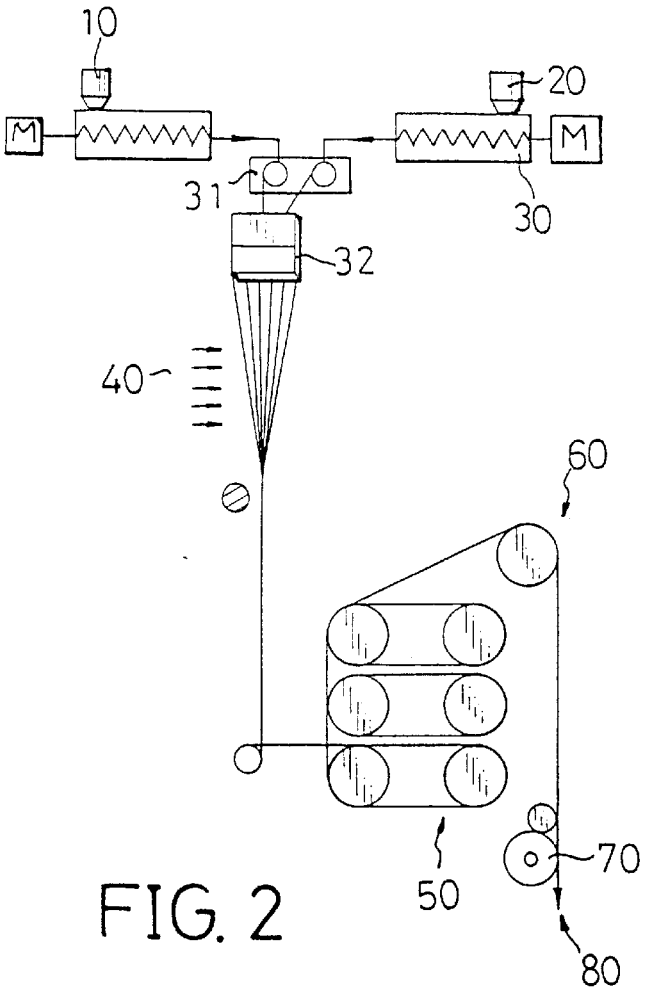
FIG. 2 is a schematic drawing showing how the polyamide and polyester are manufactured into a conjugated fiber.
Figure 3:
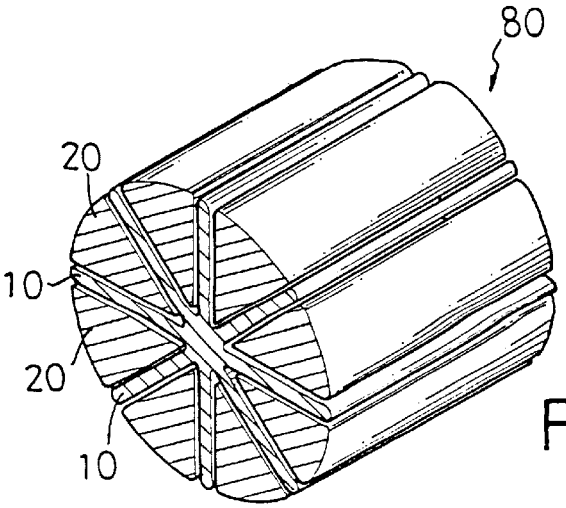
FIG. 3 is a perspective view of a segment cut from the conjugated fiber.
Figure 4:
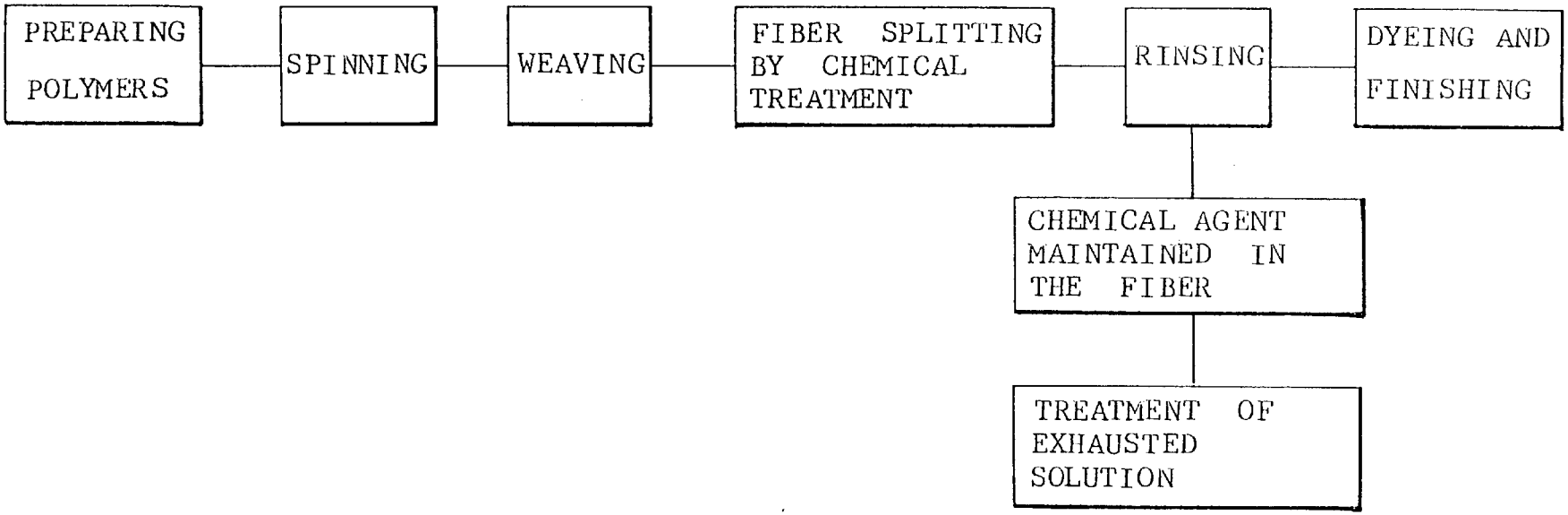
FIG. 4 PRIOR ART
FIG. 4 is a flow chart of a prior art method of fiber splitting for conjugated fiber by chemical treatment.

FIG. 6 shows a flow chart of another embodiment of the present invention, which is a method of splitting for conjugated fiber by raising a winding speed and comprises the following four steps:

i) preparing polymers: charging the first polymer 10 and the second polymer 20 respectively into corresponding extruders 30 which are the same as the extruder above-identified;

ii) spinning: the first and the second polymers 10 and 20 are transferred to a spinning zone 32 and the winding speed being raised from 3000 to 8000 meters/minute which results in a crystallization difference between the two polymers 10, 20;

iii) weaving; and iv) dyeing and finishing.

Also, the conjugated fiber will be split during the step of dyeing and finishing and no physical or chemical treatments are required.

Accordingly, the present invention provides a method of fiber splitting for conjugated fiber by adding a catalyst or a releasing agent or a nucleated agent in one of the polymers which are used to manufacture the conjugated fiber, or by differentiating the viscosity of the polymers during the preparing process, or fiber splitting by raising the winding speed of the polymers during the spinning step, both of the embodiments of the present invention can achieve the same purpose to differentiate the crystallinity between the polymers 10 and 20 in order to provide the conjugated fiber a best released status.

Furthermore, the conjugated fiber treated in the methods in accordance with the present invention is split during the process of dyeing and finishing without any physical and chemical treatments.

Although the invention has been explained in relation to its preferred embodiment, it is to be understood that many other possible modifications and variations can be made without departing from the spirit and scope of the invention as hereinafter claimed.

I claim:

1. A method of fiber splitting for conjugated fiber, comprising the steps of;

i) preparing polymers by charging a first polymer and a second polymer respectively into corresponding extruders and adding a nucleating agent into one of the first and second polymers to differentiate crystallization between the first and the second polymers;

ii) transferring said first and second polymers to a spinning zone and spinning them to a conjugated fiber via a spin pack;

iii) dyeing and finishing during which said conjugated fiber will split.

2. The method as claimed in claim 1 wherein said nucleating agent is CaSiO3 or SiO2 or MoS2 in a concentration of 1000 to 5000 ppm.

3. A method of fiber splitting for conjugated fiber, comprising the steps of:

i) preparing polymers by charging a first polymer and a second polymer respectively into corresponding extruders and adding a releasing agent into one of the first and second polymers to differentiate crystallization between the first and the second polymers;

ii) spinning transfer said first and second polymers to a spinning zone and spinning as a conjugated fiber via a spin pack;

iii) dyeing and finishing to effect a splitting of said conjugated fiber.

4. The method as claimed in claim 3 wherein said releasing agent is superfine tetrafluoroethlyene powder.

* * * * *